US009718577B2

(12) United States Patent
Martineck, Sr. et al.

(10) Patent No.: US 9,718,577 B2
(45) Date of Patent: Aug. 1, 2017

(54) LOTTERY TICKET PACK AND ASSOCIATED METHOD FOR UNWRAPPING THE PACK AND CONNECTING LOTTERY TICKETS OF ADJACENT PACKS

(71) Applicant: Scientific Games International, Inc., Newark, DE (US)

(72) Inventors: Jeffrey D. Martineck, Sr., Alpharetta, GA (US); Danielle Lea Hodges, Dawsonville, GA (US); Paula Kelly Maltman, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 198 days.

(21) Appl. No.: 14/802,312

(22) Filed: Jul. 17, 2015

(65) Prior Publication Data

US 2017/0015489 A1 Jan. 19, 2017

(51) Int. Cl.

| | |
|---|---|
| ***A45C 11/18*** | (2006.01) |
| ***B65D 5/42*** | (2006.01) |
| ***A63F 3/06*** | (2006.01) |
| ***B65B 61/18*** | (2006.01) |
| ***G07C 15/00*** | (2006.01) |

(Continued)

(52) U.S. Cl.

CPC ..... *B65D 5/4229* (2013.01); *A63F 3/065* (2013.01); *B65B 61/182* (2013.01); *B65D 75/5838* (2013.01); *B65D 83/12* (2013.01); *G07C 15/005* (2013.01)

(58) Field of Classification Search

USPC ..... 206/39, 39.1, 39.3, 39.7, 39.8, 459.5; 273/139

See application file for complete search history.

(56) References Cited

U.S. PATENT DOCUMENTS

| | | | |
|---|---|---|---|
| 3,307,858 | A | 3/1967 | Sanden |
| 4,099,721 | A | 7/1978 | Logander |
| 4,398,708 | A | 8/1983 | Goldman |

(Continued)

FOREIGN PATENT DOCUMENTS

| | | | |
|---|---|---|---|
| FR | 2 957 057 | A1 | 9/2011 |
| JP | 2005 153 943 | A | 6/2005 |
| WO | WO 03/043708 | A2 | 5/2003 |

OTHER PUBLICATIONS

PCT Search Report, Oct. 27, 2016.

*Primary Examiner* — Jacob K Ackun

(74) *Attorney, Agent, or Firm* — Dority & Manning, P.A.

(57) ABSTRACT

A lottery ticket pack and associated method for manipulating such packs is provided. Each individual lottery ticket pack is wrapped with a wrapping material, and a label is adhered to the wrapping material. The label includes a first portion permanently adhered to the wrapping material and a second portion having a releasable adhesive applied to a surface thereof. The label is grasped and pulled away from the ticket pack in a manner that causes the permanently adhered first portion of the label to tear the wrapping material from the ticket pack. Then, the remaining wrapping material is manually removed from the pack. The second portion of the label is used to connect the last ticket in the ticket pack to a first ticket in a separate unwrapped ticket pack by pressing the side of the second portion containing the releasable adhesive across aligned ends of the adjacent tickets.

13 Claims, 4 Drawing Sheets

(51) Int. Cl.
*B65D 75/58* (2006.01)
*B65D 83/12* (2006.01)

(56) References Cited

U.S. PATENT DOCUMENTS

| | | | | | |
|---|---|---|---|---|---|
| 4,909,383 | A * | 3/1990 | Gross | A63F 3/06 | 206/39 |
| 5,149,137 | A * | 9/1992 | Holt | A63F 3/06 | 206/39.1 |
| 5,482,509 | A | 1/1996 | Dull | | |
| 5,573,110 | A * | 11/1996 | Nguyen | B42F 7/065 | 150/147 |
| 7,021,493 | B2 | 4/2006 | Brickwood | | |
| 2014/0116899 | A1 * | 5/2014 | Dixon | B42F 7/06 | 206/39 |
| 2015/0042041 | A1 | 2/2015 | Bedford | | |

* cited by examiner

LOTTERY TICKET PACK AND ASSOCIATED METHOD FOR UNWRAPPING THE PACK AND CONNECTING LOTTERY TICKETS OF ADJACENT PACKS

BACKGROUND

Instant lottery tickets (e.g. scratch-off lottery tickets) are sold at many types of retail locations including, stores, such as grocery stores, general merchandise stores, and the like. The lottery tickets are typically delivered to the retail establishments in the form of a continuous strip with serrations or perforation between individual, sequentially numbered tickets. The strips are fan-folded into individual packs or bundles and wrapped in a secure manner with cellophane or a similar material that must be removed prior to placing the packs into a dispenser. The wrapping is generally secure and tight (i.e., may be vacuumed sealed) against the ticket pack, and removing the wrapping can be problematic. Often the store clerk must locate and use a sharp object to first pierce the wrapping before the wrapping can be removed by hand. The sharp object may result in damage to one or more tickets (rendering the ticket potentially unsaleable), or to an injury to the clerk.

In addition, multiple ticket packs are generally loaded into a single dispenser in sequential order between the last ticket in a first pack and the first ticket in the next adjacent pack within the dispenser. These last and first tickets must be connected together in order to ensure the continuity of the strip of tickets upon pulling the tickets from the dispenser slot. The conventional practice is for the store clerk to tape the last and first tickets together, which again requires the clerk to locate a suitable tape. Certain tapes, however, are not releasable from the ticket substrate after being applied, and the tape can damage either or both of the tickets it is attached to, thereby rendering the tickets unsaleable.

Thus, a need exists in the industry for a method and system wherein lottery ticket packs can be readily unwrapped without an external tool, and also connected together without external tape or other means that may damage the tickets.

SUMMARY

Objects and advantages of the invention will be set forth in part in the following description, or may be obvious from the description, or may be learned through practice of the invention.

In accordance with aspects of the invention, a method is provided for manipulating packs of interconnected lottery tickets, such as "instant" or "scratch-off" lottery tickets that are connected together in a continuous string and separated by perforation lines. It should be appreciated that the present invention is not limited to any particular type or style of lottery ticket, and that the scratch-off tickets are referenced herein for sake of illustration only. Each individual lottery ticket pack is wrapped with a wrapping material, such as cellophane or a similar material that functions to protect the ticket packs during transit and storage. A label is adhered to the wrapping material and may include any manner of printed indicia that identifies the ticket pack or contains other pack/ticket accountability information.

The label includes a first portion that is permanently adhered to the wrapping material, for example with a strong adhesive selected so that the first portion cannot be separated from the wrapping material. The label includes a second portion having a releasable adhesive applied to a surface thereof. The "releasable adhesive" is selected so as to allow the second portion of the label to be adhered to a lottery ticket and subsequently removed from the lottery ticket without damaging the lottery ticket, as explained in greater detail below.

In order to load the ticket pack into a dispenser, the method includes grasping and pulling the label away from the ticket pack in a manner that causes the permanently adhered first portion of the label to tear the wrapping material from the ticket pack. After this initial tear, it is relatively easy to manually remove the rest of the wrapping material from the ticket pack.

In order to connect the unwrapped ticket pack to another unwrapped ticket pack, the method includes using the second portion of the label to connect (e.g., bridge) the last ticket in the ticket pack to a first ticket in a separate unwrapped ticket pack by pressing the second label portion onto the aligned tickets. In this manner, the connected ticket packs form a continuous stream as the tickets are individually dispensed from the dispenser.

In a particular embodiment, the first and second portions of the label are linearly adjacent and defined by a perforation line, wherein the method includes separating the second portion of the label from the first portion along the perforation line after unwrapping the ticket packet. In this embodiment, the releasable adhesive may be applied to an underside of the second portion of the label such that the second portion is releasably adhered to the wrapping material, wherein the method includes peeling the second portion away from the wrapping material prior to pulling on the label to tear the wrapping material. The second portion may be removed from the first portion during the pulling process, or may remain intact with the first portion in order to tear the wrapping material.

In an alternate embodiment, the releasable adhesive is applied to a surface of the second portion and covered by a protective release liner, wherein the method includes removing the release liner prior to using the second portion to connect the tickets.

In still another embodiment, the second portion of the label overlies the first portion of the label, wherein the method includes removing the second portion of the label from the first portion before or after tearing the wrapping material with the label.

The present invention also encompasses various embodiments of a lottery ticket packet incorporating any combination of the aspects discussed above. For example, a lottery ticket pack according to the invention may include a fan-folded configuration of individual lottery tickets separated by perforation lines, wherein the fan-folded configuration is wrapped with a wrapping material to form a wrapped ticket pack. A label is applied to the wrapping material; the label containing indicia relevant to the ticket pack (e.g., pack identification indicia). The label includes a first portion permanently adhered to the wrapping material and a second portion having a releasable adhesive applied to a surface thereof.

In a particular ticket pack embodiment, the first and second portions of the label are linearly adjacent and defined by a perforation line (which encompasses any type of weakened separation line). In this embodiment, the releasable adhesive may be applied to an underside of the second portion such that the second portion is releasably adhered to and removable from the wrapping material by manually peeling the second portion away from the wrapping material.

In another embodiment, the releasable adhesive is applied to a surface of the second portion and covered by a protective release liner, which is removed prior to using the label to later connect together tickets of adjacent packs. The releasable adhesive may be applied to an underside of the second portion such that the release liner is between the wrapping material and the releasable adhesive.

In yet another ticket pack embodiment, the second portion of the label overlies the first portion of the label with the releasable adhesive between the first and second portions and adhering to the second portion upon peeling the second portion away from the first portion.

BRIEF DESCRIPTION OF THE DRAWINGS

A full and enabling disclosure including the best mode of practicing the appended claims and directed to one of ordinary skill in the art is set forth more particularly in the remainder of the specification. The specification makes reference to the appended figures, in which:

DETAILED DESCRIPTION

Figure 1A:
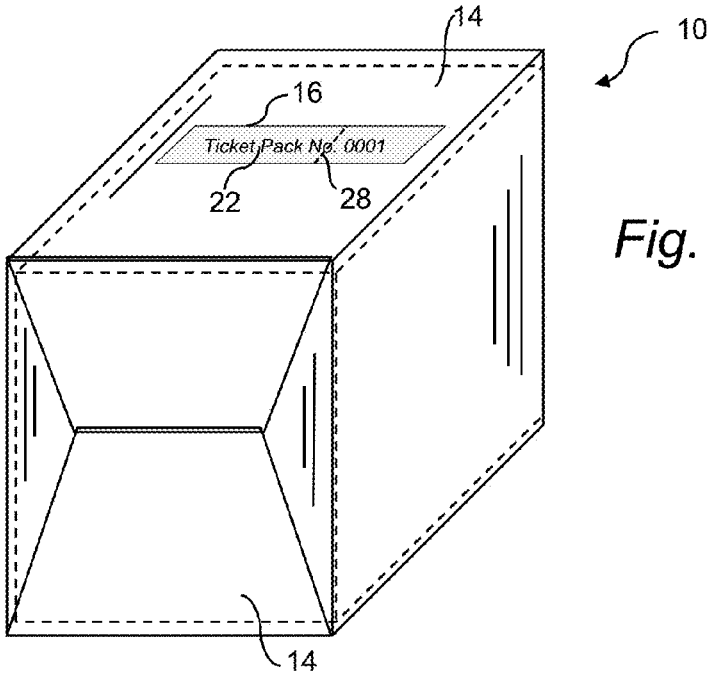
FIG. 1*a* is a perspective view of a wrapped ticket pack in accordance with aspects of the present invention.

Reference will now be made in detail to various and alternative exemplary embodiments and to the accompanying drawings, with like numerals representing substantially identical structural elements. Each example is provided by way of explanation, and not as a limitation. In fact, it will be apparent to those skilled in the art that modifications and variations can be made without departing from the scope or spirit of the disclosure and claims. For instance, features illustrated or described as part of one embodiment may be used on another embodiment to yield a still further embodiment. Thus, it is intended that the present disclosure includes modifications and variations as come within the scope of the appended claims and their equivalents.

Referring to the figures in general, a method for manipulating packs 10 of interconnected lottery tickets 12, such as "instant" or "scratch-off" lottery tickets that are connected together in a continuous string and separated by perforation lines 13, is illustrated. Each individual lottery ticket pack 10 is wrapped with a wrapping material 14, which may be any suitable protective, pliable material, such as cellophane. The manner in which the packs 10 are wrapped is not a limiting factor of the invention.

A label 16 is adhered to the wrapping material at any suitable location. The label may include any manner of indicia 22 for any purpose. For example, the indicia 22 may identify the pack 10 by lot number, date, delivery location, etc. The label 22 may include any manner of barcode containing such information. The type or content of the indicia 22 is not relevant to the present invention. The label 16 may be made from any suitable material (e.g., paper, plastic, polymer, etc.) that can withstand the pulling and shear forces exerted on the label 16 to tear the wrapping material 14, as described herein.

The label 16 includes a first portion 18 that is "permanently" adhered to the wrapping material 14 in the sense that the first portion 18 will not peel away from the wrapping material 14 when exerting sufficient force on the label 16 to tear the wrapping material. The first portion 18 may be attached with a commercially available adhesive 24 having the "permanent" characteristics described herein.

The label 16 includes a second portion 20 that is removable from the first portion 18 along a separation line 28, such as a perforated or otherwise weakened line 28. The second portion has a releasable adhesive 26 applied to a surface thereof. For example, in the embodiments depicted in the figures, the releasable adhesive 26 is applied to an underside of the second portion 20 that is adjacent to the wrapping material 14.

Figure 1B:
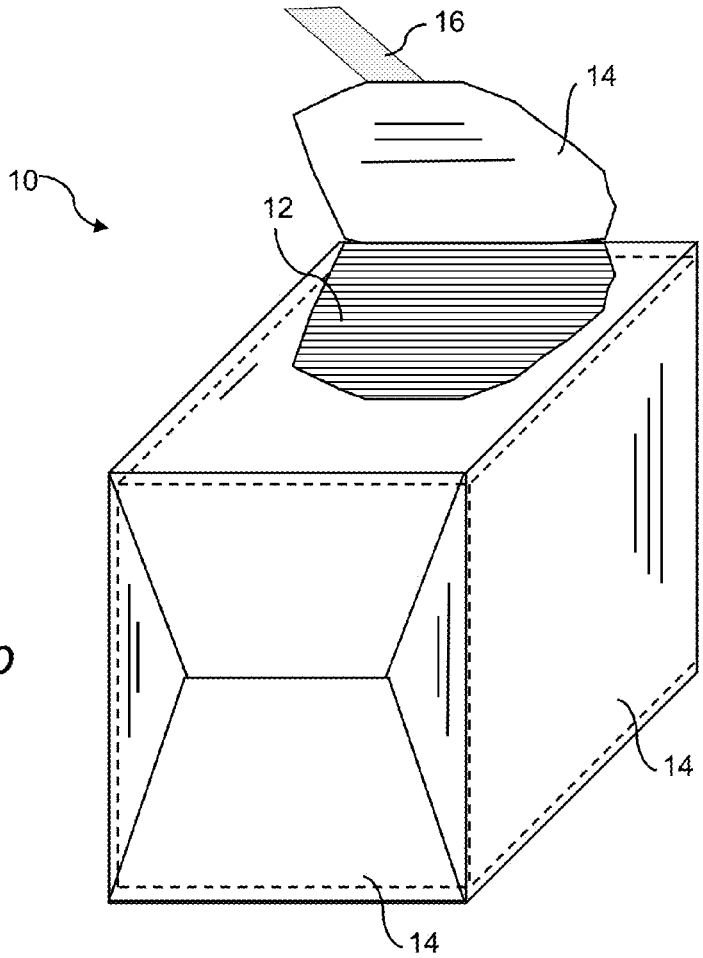
FIG. 1*b* is a perspective view of the ticket pack of FIG. 1 in a partially unwrapped condition.
Figure 2A:
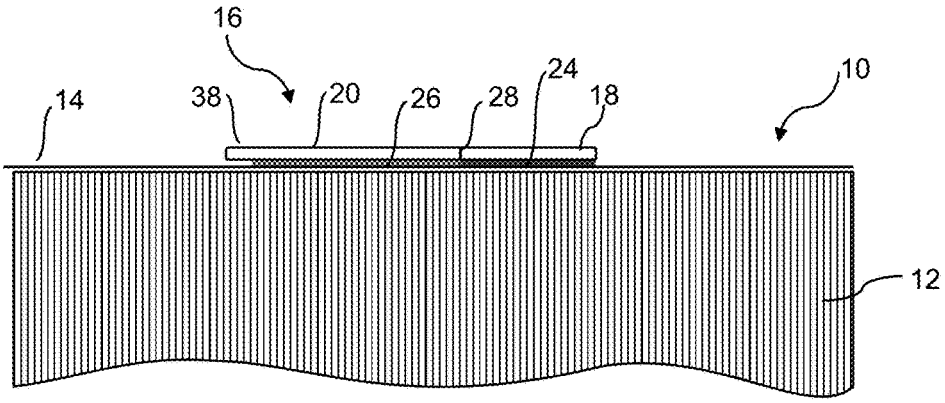
FIGS. 2*a* through 2*c* are sequential views illustrating unwrapping of a ticket pack with a pre-applied label according to a particular embodiment.
Figure 2B:
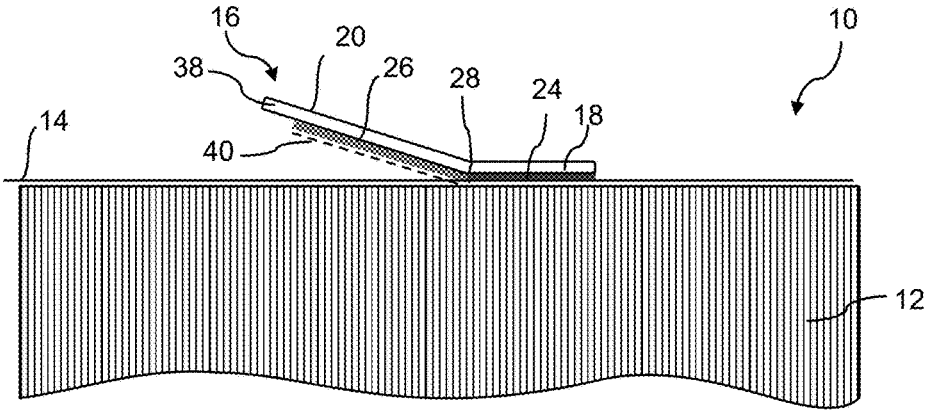
Figure 2C:
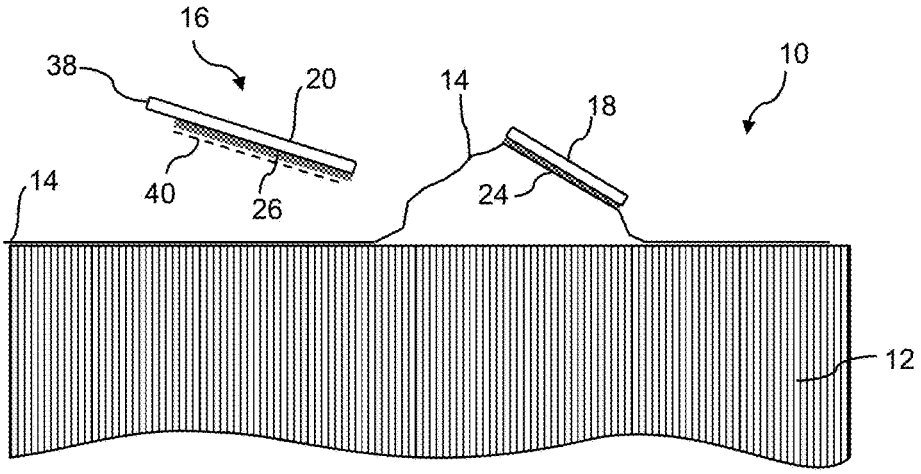

FIG. 1*a* illustrates the ticket pack 10 with the label 16 applied to the wrapping material 14 on an upper surface of the ticket pack 10. FIG. 1*b* depicts the same ticket pack 10 after a person (e.g., retail store clerk) has grasped the label 16 and pulled with sufficient force to tear the wrapping material 14 away from the ticket pack 10, as depicted in FIGS. 2*a* through 2*c*. In this embodiment, the second portion 20 is the portion of the label 16 that is grasped and pulled. The second portion 20 may include an un-adhered grasping tab or portion 28 that provides an easy access point for the clerk to initially grasp the label 16. Once the wrapping material is initially torn away, as depicted in FIG. 1*b*, it is a relatively easy exercise for the clerk to manually remove the rest of the wrapping material 14 from the ticket pack 10.

In the embodiment of FIGS. 2*a* through 2*c*, the releasable adhesive 26 on the underside of the second label portion 20 directly attaches the second portion 20 to the wrapping material. However, because of the releasable characteristics of the adhesive 26, the second portion 20 peels away from the wrapping material 14 upon pulling the label (e.g., grasping and pulling on the tab 28), and it is the permanent connection between the first portion 18 and the wrapping material 14 that causes the material 14 to eventually tear. In this embodiment, the separation line 28 between the first portion 18 and second portion 20 has sufficient strength to withstand the force needed to tear the wrapping material 14.

Figure 4A:
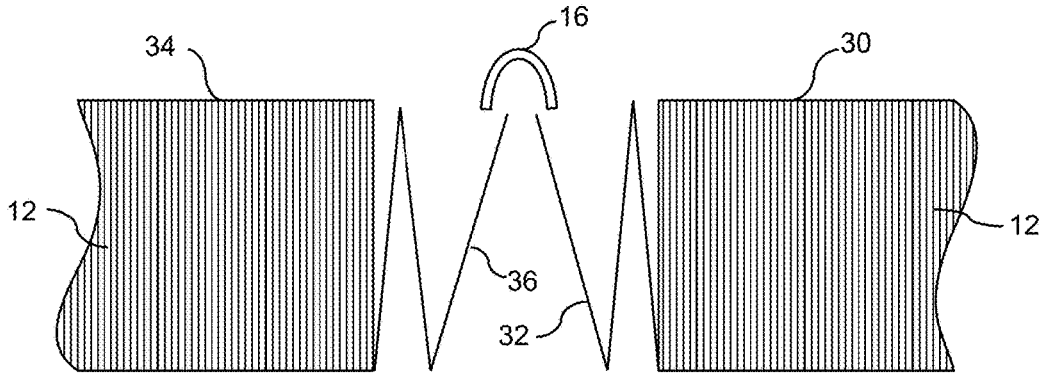
FIGS. 4*a* and 4*b* are sequential views illustrating connecting together tickets of adjacent packs with the pre-applied label.
Figure 4B:
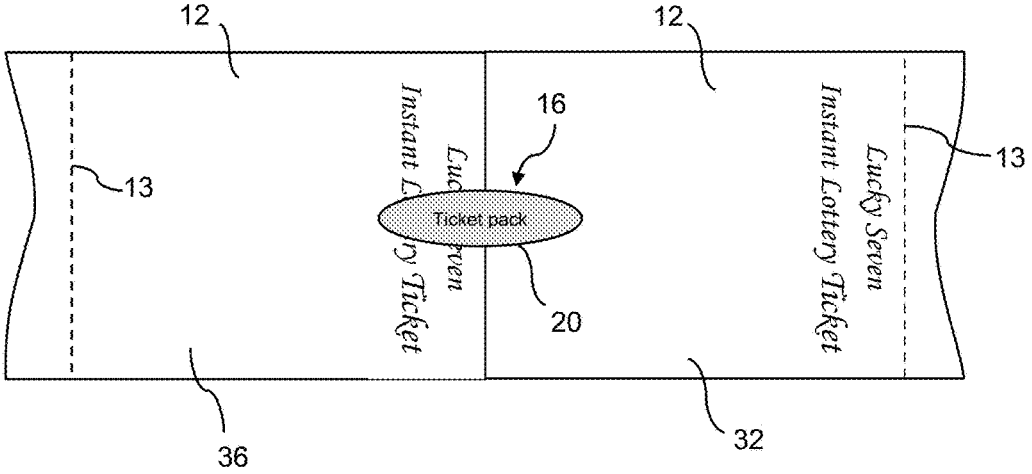

Referring to FIGS. 2*c*, 4*a*, and 4*b*, the method includes using the second portion 20 of the label 16 to connect the last ticket 32 in the ticket pack 30 to a first ticket 36 in a separate unwrapped ticket pack 34. This is done so that, when loaded into a dispenser, the ticket packs 30, 34 form a continuous stream of tickets 12. In other words, the last ticket 32 in pack 30 is connected to (via the label 16) and pulls along the first ticket 36 in pack 34. The label 16 forms a connecting bridge between the tickets 32, 36, as depicted in FIG. 4*b*, by pressing the side of the second portion 20 containing the releasable adhesive 26 across aligned ends of the adjacent tickets.

In the embodiment of FIGS. 2*a* through 2*c*, the first 18 and second 20 portions of the label 16 are linearly adjacent and defined by the perforation line 28. As depicted in FIG. 2*c*, the method includes separating the second portion 20 from the first portion 18 along the perforation line 28 after unwrapping the ticket packet 10.

As mentioned above, in the embodiment of FIGS. 2*a* through 2*c*, the second portion 20 of the label remains attached to the first portion 18 during the pulling and tearing of the wrapping material 14, and is then separated from the first portion 20. In an alternate embodiment, the method may include separating the second portion 20 from the first portion 18 prior to the pulling process, wherein only the first portion 18 remains attached to the wrapping material 14 and is pulled to tear the wrapping material.

FIGS. 2*b* and 2*c* depict a release liner 40 (dashed lines) attached to the releasable adhesive 26 on the underside of the second portion 20. This liner 40 protects the adhesive 26 and prevents the adhesive 26 form adhering to the wrapping material 40. If used, the release liner 40 would be removed and discarded prior to using the second portion 20 as a connecting means as depicted in FIGS. 4*a* and 4*b*.

Figure 3A:
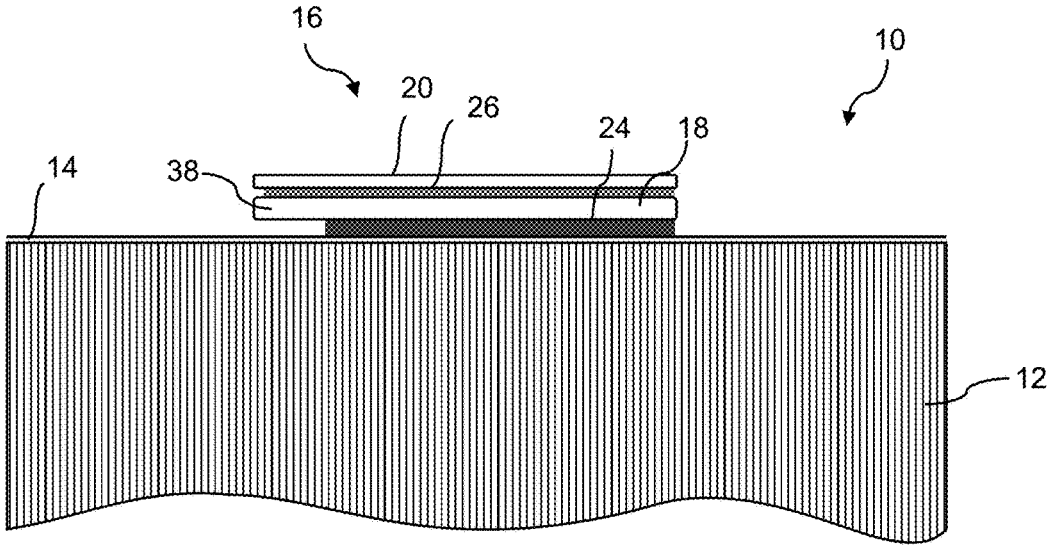
FIGS. 3*a* and 3*b* are sequential views illustrating unwrapping of a ticket pack with a pre-applied label according to an alternate embodiment.
Figure 3B:
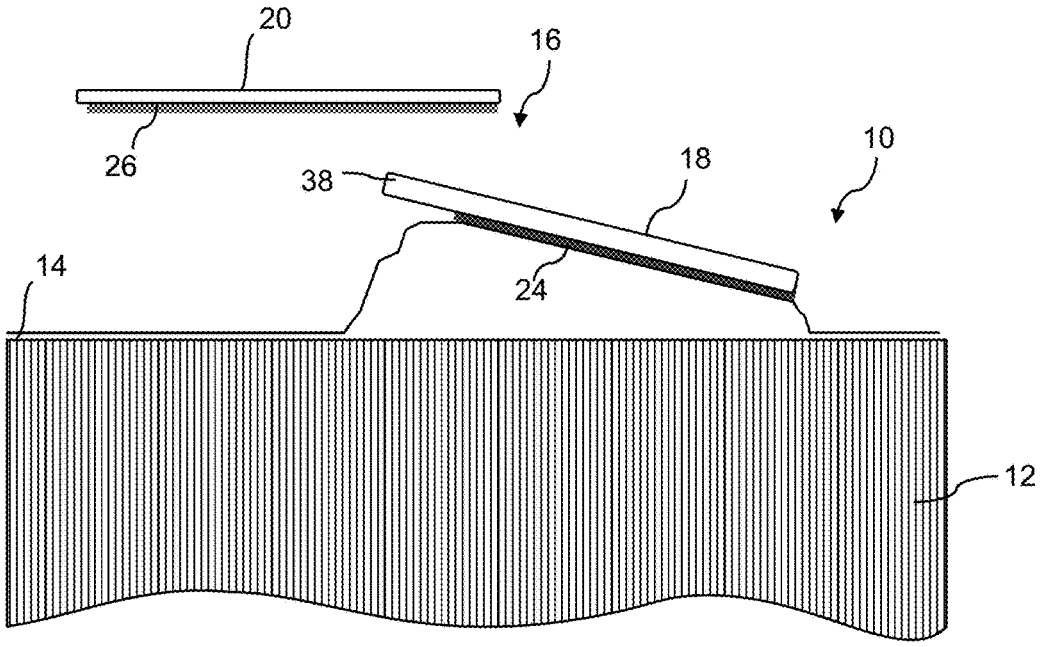

In the embodiment depicted in FIGS. 3*a* and 3*b*, the second portion 20 of the label 16 overlies the first portion 18, with the releasable adhesive 26 between the two portions 18, 20. With this embodiment, the second portion 20 (with attached releasable adhesive 26) can be removed from the first portion 18 either before or after tearing the wrapping material 14 with the first portion 18.

The present invention also encompasses a lottery ticket packet 18 having the characteristics discussed above.

The material particularly shown and described above is not meant to be limiting, but instead serves to show and teach various exemplary implementations of the present subject matter. As set forth in the attached claims, the scope of the present invention includes both combinations and sub-combinations of various features discussed herein, along with such variations and modifications as would occur to a person of skill in the art.

What is claimed is:

1. A method for manipulating packs of interconnected lottery tickets, wherein each individual lottery ticket pack is wrapped with a wrapping material and a label is adhered to the wrapping material, wherein the label includes a first portion permanently adhered to the wrapping material and a second portion having a releasable adhesive applied to a surface thereof, the method comprising:

grasping and pulling the label away from the ticket pack in a manner that causes the permanently adhered first portion of the label to tear the wrapping material from the ticket pack;

manually removing all of the wrapping material from the ticket pack; and using the second portion of the label to connect the last ticket in the ticket pack to a first ticket in a separate unwrapped ticket pack by pressing the side of the second portion containing the releasable adhesive across aligned ends of the adjacent tickets.

2. The method as in claim 1, wherein the first and second portions of the label are linearly adjacent and defined by a perforation line, the method including separating the second portion of the label from the first portion along the perforation line after unwrapping the ticket packet.

3. The method as in claim 2, wherein the releasable adhesive is applied to an underside of the second portion such that the second portion is releasably adhered to the wrapping material, the method comprising peeling the second portion away from the wrapping material prior to pulling the label in order to tear the wrapping material.

4. The method as in claim 3, wherein the second portion is removed from the first portion prior to pulling the first portion in order to tear the wrapping material.

5. The method as in claim 3, wherein the second portion is used to pull the label in order to tear the wrapping material, and is then separated from the first portion.

6. The method as in claim 2, wherein the releasable adhesive is applied to a surface of the second portion and covered by a protective release liner, the method comprising removing the release liner prior to using the second portion to connect the tickets.

7. The method as in claim 1, wherein the second portion of the label overlies the first portion of the label, the method comprising removing the second portion of the label from the first portion before or after tearing the wrapping material with the label.

8. A lottery ticket packet, comprising:

a fan-folded configuration of individual lottery tickets separated by perforation lines;

the fan-folded configuration wrapped with a wrapping material to form a wrapped ticket pack;

a label applied to the wrapping material, the label containing indicia relevant to the ticket pack; and the label comprising a first portion permanently adhered to the wrapping material and a second portion having a releasable adhesive applied to a surface thereof.

9. The lottery ticket packet as in claim 8, wherein the first and second portions of the label are linearly adjacent and defined by a perforation line.

10. The lottery ticket packet as in claim 9, wherein the releasable adhesive is applied to an underside of the second portion such that the second portion is releasably adhered to and removable from the wrapping material by manually peeling the second portion away from the wrapping material.

11. The lottery ticket packet as in claim 9, wherein the releasable adhesive is applied to a surface of the second portion and covered by a protective release liner.

12. The lottery ticket packet as in claim 9, wherein the releasable adhesive is applied an underside of the second portion such that the release liner is between the wrapping material and the releasable adhesive.

13. The lottery ticket packet as in claim 9, wherein the second portion of the label overlies the first portion of the label with the releasable adhesive between the first and second portions and adhering to the second portion upon peeling the second portion away from the first portion.

* * * * *